United States Patent [19]

Bentley

[11] 4,449,892

[45] May 22, 1984

[54] PUMP WITH ROTARY SONIC PRESSURE WAVE GENERATOR

[76] Inventor: Arthur P. Bentley, P.O. Box 1952, Roswell, N. Mex. 88201

[21] Appl. No.: 412,802

[22] Filed: Aug. 30, 1982

Related U.S. Application Data

[63] Continuation-in-part of Ser. No. 396,119, Jul. 7, 1982, which is a continuation-in-part of Ser. No. 254,451, Apr. 15, 1981, Pat. No. 4,381,777, which is a continuation-in-part of Ser. No. 253,317, Apr. 13, 1981, Pat. No. 4,398,870, which is a continuation-in-part of Ser. No. 160,934, Jun. 19, 1980, Pat. No. 4,341,505, which is a continuation-in-part of Ser. No. 958,552, Nov. 8, 1978, Pat. No. 4,259,799.

[51] Int. Cl.[3] ..... F04F 7/00

[52] U.S. Cl. ..... 417/240; 417/83; 417/172

[58] Field of Search ..... 417/240, 241, 80, 83, 417/87, 172

[56] References Cited

U.S. PATENT DOCUMENTS

| | | | |
|---|---|---|---|
| 2,077,213 | 4/1937 | Conery et al. | 417/172 X |
| 2,857,081 | 10/1958 | Lung | 417/83 X |
| 2,909,127 | 10/1959 | Bradaska | 417/172 |

*Primary Examiner*—Leonard E. Smith

*Attorney, Agent, or Firm*—Herbert E. Haynes, Jr.

[57] ABSTRACT

A sonic pressure wave operated pump is provided with a rotary sonic pressure wave generator which impactingly generates sonic pressure waves of special character in a column of liquid contained in the pump with the generated sonic pressure waves being transmitted through a metallic production tube about the inner walls of the tube to a pumping unit which is in communication with a liquid to be pumped. The pumping unit reflects the generated sonic pressure waves back into the center of the production tube for movement countercurrent to the movement of the generated sonic pressure waves with the pumping unit reacting to the reflection of the sonic pressure waves by intaking the liquid that is to be pumped so that it is carried through the production tube with the reflected sonic pressure waves.

16 Claims, 5 Drawing Figures

FIG. 3
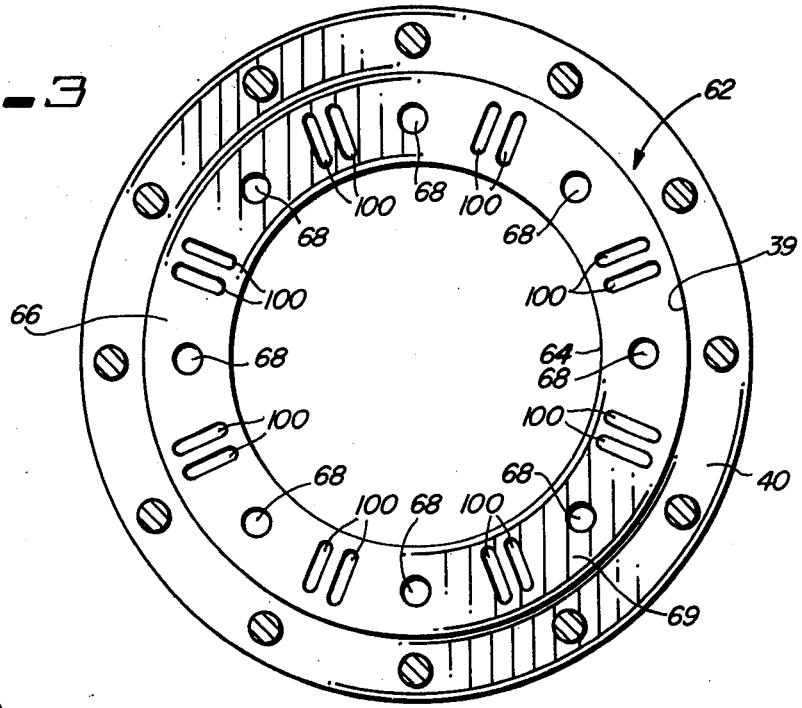
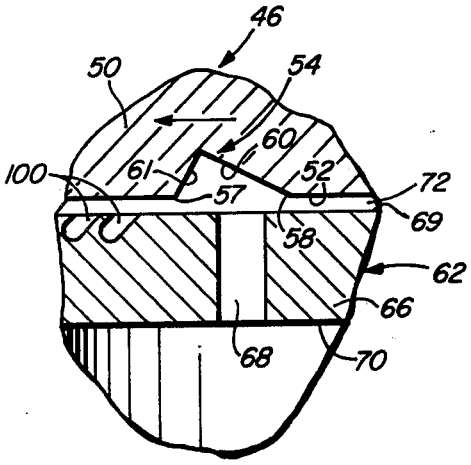
FIG. 5
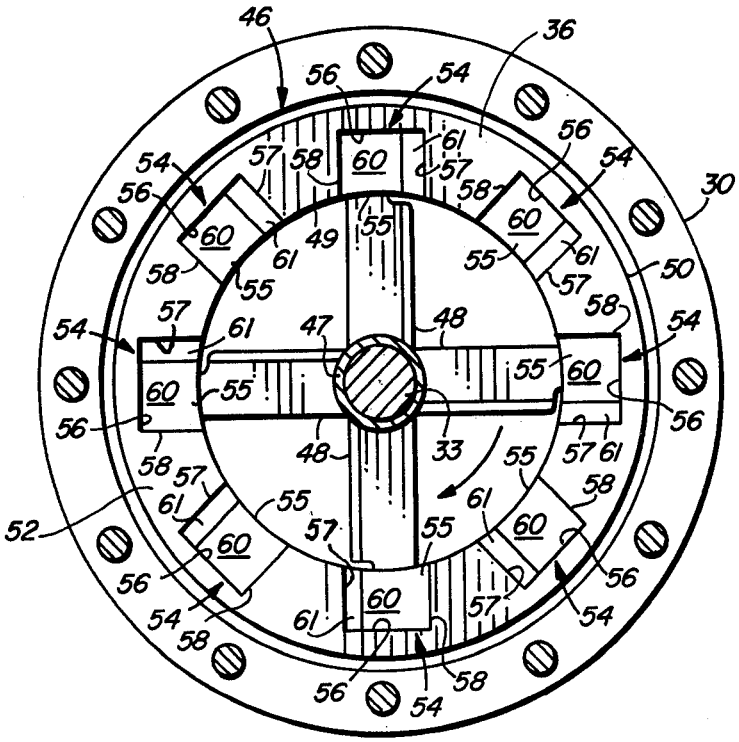
FIG. 4

PUMP WITH ROTARY SONIC PRESSURE WAVE GENERATOR

CROSS REFERENCE TO RELATED APPLICATIONS

This application is a continuation-in-part of copending prior U.S. patent application Ser. No. 396,119, filed July 7, 1982, for SONIC PRESSURE WAVE SURFACE OPERATED PUMP WITH EXTENSIBLE PUMPING ASSEMBLY, which is a continuation-in-part of prior pending U.S. patent application Ser. No. 254,451, filed Apr. 15, 1981, for VARIABLE VOLUME SONIC PRESSURE WAVE SURFACE OPERATED PUMP, which issued as U.S. Pat. No. 4,381,777, which is a continuation-in-part of prior pending U.S. patent application Ser. No. 253,317, filed Apr. 13, 1981, for SONIC PRESSURE WAVE SURFACE OPERATED PUMP, which issued as U.S. Pat. No. 4,398,870, which is in turn a continuation-in-part of prior pending U.S. patent application Ser. No. 160,934, filed June 19, 1980, for SONIC PRESSURE WAVE PUMP FOR LOW PRODUCTION WELLS, which issued as U.S. Pat. No. 4,341,505, on July 27, 1982, which is in turn a continuation-in-part of prior U.S. patent application Ser. No. 958,552, filed Nov. 8, 1978, for SONIC PRESSURE WAVE SURFACE OPERATED PUMP, which issued as U.S. Pat. No. 4,259,799, on Oct. 20, 1981, all by the same inventor.

BACKGROUND OF THE INVENTION

1. Field of the Invention

This invention relates to pumps and more particularly to a sonic pressure wave operated pump having a rotary sonic pressure wave generator.

2. Description of the Prior Art

The most commonly used liquid pumping mechanism includes an electrically, or otherwise, powered motor which drives a shaft, commonly referred to as "sucker rods", which extend from the motor at ground level downwardly through a well casing to drive a down hole pumping device. Such pumps are costly, expensive to install and maintain and are expensive to operate.

In attempts to reduce the costs associated with the above described type of prior art pump, and other well known pumps, another basic type of pumping mechanism has been suggested. This suggested pumping mechanism includes a reciprocally operated piston structure for imparting an intermittent pressure wave on a column of liquid contained in pump tubing which extends from the subterranean source of the liquid to an above ground location. In general, the pressure waves are generated by an above ground mechanism, which reciprocally impacts the column of liquid and, in addition, will cyclically open and close a liquid delivery port. Such impacting of the column of liquid produces pressure waves that are transmitted by the liquid to the down hole pumping device, such as a standing valve, to impart a reciprocal movement thereto. The down hole pumping device usually includes a plunger, or similar mechanism, which is biased upwardly by suitable springs and has a central passage formed axially therethrough with a one-way check valve located in the passage. When the hydraulic pressure waves move the plunger down against the spring bias, the check valve opens to admit the liquid being pumped into the passage. And, the subsequent upstroke of the plunger closes the check valve and causes a general upward movement of the liquid column with the uppermost portion thereof discharging an amount of liquid through the delivery port, with the delivered amount being equal to the amount taken in by the down hole pumping device.

Examples of pumping mechanisms which operate generally in the above described manner are fully disclosed in U.S. Pat. Nos. 2,379,539; 2,355,618; 2,428,460; 2,572,977; 2,751,848 and 3,277,381.

These prior art pumps critically depend on ideal adjustments of the input frequency relative to the length of the pump tubing in which the liquid column is contained. That is, resonant timing. Further, these prior art pumps are seriously limited as to their pumping capacity due to fluid friction, inertia of the liquid, and the like. The problems with resonant timing, frictional losses, and the like, have kept these prior art pumps from achieving any significant degree of commercial success.

Therefore, a need exists for a new and improved pumping mechanism which overcomes some of the problems and shortcomings of the prior art.

SUMMARY OF THE INVENTION

In accordance with the present invention, a new and useful sonic pressure wave surface operated pump is disclosed for pumping liquids. The pump includes a sonic pressure wave generator of special configuration which generates sonic pressure waves in a column of liquid which is coupled through a metallic production, or pumping, tube which extends from the sonic pressure wave generator to the liquid to be pumped. A pumping unit is mounted on the extending end of the production tube for reflecting the received sonic pressure waves back through the production tube and is operated by the sonic pressure waves to admit the liquid to be pumped into the pumping unit so that the reflected sonic pressure waves can, in conjunction with a mechanical pumping action provided by the sonic pressure wave generator, carry the liquid to be pumped toward the sonic pressure wave generator which directs the pumped liquid to a suitable liquid receiving or utilization facility.

The sonic pressure wave generator includes an especially configured rotor and stator assembly carried in a chamber defined by a housing with a suitable drive means, such as an electric motor, being coupled to the rotor for driving thereof. The housing has the metallic production tube coupled thereto so that its bore is in communication with the chamber thereof, and a liquid delivery port is formed to extend from the housing. With the pump primed, i.e., containing the column of liquid, and the rotor being driven by the drive means, the rotor and stator interact to impact the column transversely in a concentric ring adjacent the periphery thereof a plurality of times for each revolution of the rotor, with this impacting producing sonic pressure waves of special character which move from the sonic pressure wave generator through the metallic production tube adjacent the inner walls of the tube.

The stator is a substantially ring-shaped disc having a plurality of apertures passing through its stator body with those apertures being in a circular array which is concentric with the central opening of the stator. The rotor is of similar configuration with a plurality of impeller blades extending radially from a hub to its ring-shaped rotor body. The rotor and stator are disposed in axially aligned relationship with the downwardly facing surface of the rotor body being in spaced overlaying relationship with the upperwardly facing surface of the stator. The downwardly facing surface of the rotor is formed with a plurality of especially configured cavities which are disposed so as to pass over the apertures of the stator as the rotor is driven relative to the fixed stator. Each time the special cavities of the rotor pass over the passages of the stator, a column impacting occurs and sonic pressure waves are generated which, as hereinbefore mentioned, move toward the pumping unit carried on the extending end of the production tube. The exact nature of the sonic pressure waves is not fully understood, but it is known that they operate the pump of the present invention with unexpectedly high production capabilities in view of the relatively low operating power consumption.

The pumping unit carried on the extending end of the production tube is provided with a special reflector/aspirator structure having a central orifice which is open to an axially aligned liquid admitting chamber which is in communication with the liquid to be pumped via a one-way check valve means provided in the open end of the pumping unit. The check valve means is normally closed due to head pressure of the standing column of liquid. The generated sonic pressure waves are received from the production tube and are reflected back into the production tube, so that the reflected sonic pressure waves move centrally therethrough in a path countercurrent to the movement path of the generated sonic pressure waves. The reflection of the sonic pressure waves produces an aspirator action which provides a partial vacuum in the liquid admitting chamber which opens the check valve and draws the liquid to be pumped into the admitting chamber with the admitted liquid moving through the orifice where it is carried by the reflected sonic pressure waves back to the sonic pressure wave generator. The action of the liquid being carried by the reflected sonic pressure waves to the sonic pressure wave generator is augmented by the impeller blades provided on the rotor of the sonic pressure wave generator with the result being that the pumped liquid passes through the generator housing to the liquid delivery port thereof and from there to a suitable point of use or receiving and storage facility.

The sonic pressure wave pump of the present invention is unexpectedly efficient as hereinbefore mentioned, and this efficiency is believed to result from the special character of the sonic pressure waves, and exactly what happens is not clearly understood. It is, however, known that the special configuration and interaction of the rotor and stator structures results in the generation and movement of the generated sonic pressure waves along the inner walls of the production tube in a manner which apparently does not apply any flow restricting forces on the liquid moving counter-currently through the center of the production tube. It is believed that the generated sonic pressure waves which move along the inner walls of the production tube form a friction reducing membrane the nature of which is unknown.

Accordingly, it is an object of the present invention to provide a new and useful pump.

Another object of the present invention is to provide a new and useful sonic pressure wave operated pump.

Another object of the present invention is to provide a new and useful sonic pressure wave operated pump having a higher operating efficiency than other known pumps.

Another object of the present invention is to provide a new and useful sonic pressure wave operated pump which includes a sonic pressure wave generator having a pumped liquid output port and which is coupled by a metallic production tube to a pumping unit that is carried on the extending end of the production tube for placement in communication with a liquid to be pumped.

Another object of the present invention is to provide a new and useful sonic pressure wave operated pump of the above described character wherein the sonic pressure wave generator includes an especially configured rotor/stator assembly which interacts to impact a column of liquid carried in the pump to generate special sonic pressure waves which move through the metallic production tube along the inner walls thereof to the pumping unit carried on the extending end of the production tube for operation of the pumping unit.

Another object of the present invention is to provide a new and useful sonic pressure wave operated pump of the above described character wherein the generated sonic pressure waves are received from the production tube in a reflector/aspirator structure provided in the pumping unit which reflects the sonic pressure waves so that they move back into the center of the production tube and move therethrough in a path countercurrent to the generated sonic pressure waves, and in doing so, produce a partial vacuum in a liquid admitting chamber of the pumping unit, to open a oneway check valve and draw the liquid to be pumped therein so that it is carried by the reflected sonic pressure waves to the sonic pressure wave generator.

Still another object of the present invention is to provide a new and useful sonic pressure wave surface operated pump of the above described type wherein action of the pumped liquid being carried by the reflected sonic pressure waves is augmented by an impeller means provided in the rotor of the sonic pressure wave generator.

The foregoing and other objects of the present invention as well as the invention itself, may be more fully understood from the following description when read in conjunction with the accompanying drawings.

BRIEF DESCRIPTION OF THE DRAWINGS

FIG. 3 is a sectional view taken along the line 3—3 of FIG. 2 to illustrate the preferred configuration of the stator provided in the sonic pressure wave generator.

FIG. 4 is a sectional view taken along the line 4—4 of FIG. 2 to illustrate the preferred configuration of the liquid impacting face of the rotor provided in the sonic pressure wave generator.

FIG. 5 is an enlarged fragmentary sectional view taken along the line 5—5 of FIG. 2.

DESCRIPTION OF THE PREFERRED EMBODIMENT

Figure 1:
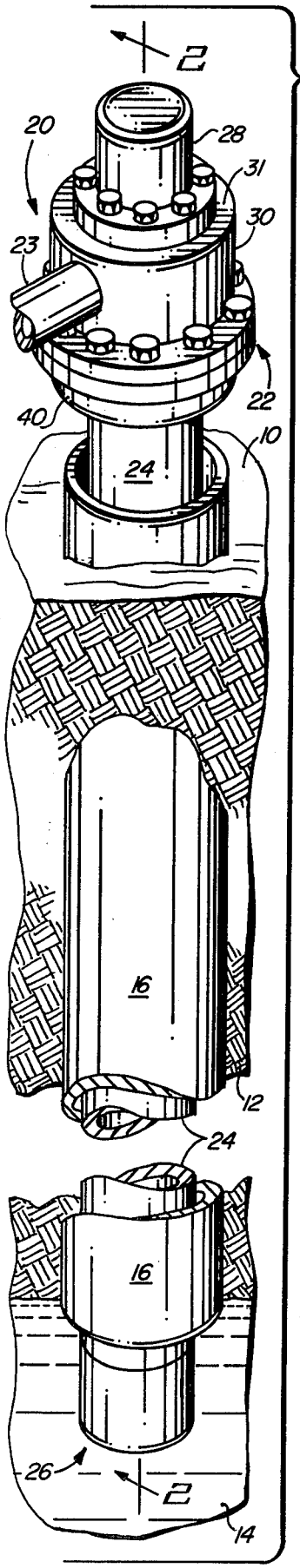
FIG. 1 is a fragmentary perspective view of the sonic pressure wave operated pump of the present invention with the pump being shown in a ground formation which is shown in section.

Referring more particularly to the drawings, FIG. 1 illustrates a ground formation having a surface level 10, an underground portion 12 in which a liquid 14, such as water, is located. The illustrated ground formation is intended to be illustrative of a typical liquid production well, and therefore is seen to include a well casing 16 which, in accordance with standard well known practices, communicates between the subterranean liquid 14 and the surface level 10.

As will hereinafter be described in detail, a sonic pressure wave operated pump which is indicated generally by the reference numeral 20, is located in the ground formation in the conventional manner and includes the major components of a rotary sonic pressure wave generator 22 having a pumped liquid discharge pipe 23 extending therefrom, a metallic production tube, or conduit, 24 depending from the generator 22 through the well casing 16, with a pumping unit 26 mounted on the extending end of the production tube 24 so as to be in communication with the liquid 14. A drive means 28, which may be any of several well known mechanisms, is shown for completeness of this disclosure as being in the form of an electric motor which is mounted on the sonic pressure wave generator 22 for rotary driving thereof.

Figure 2:
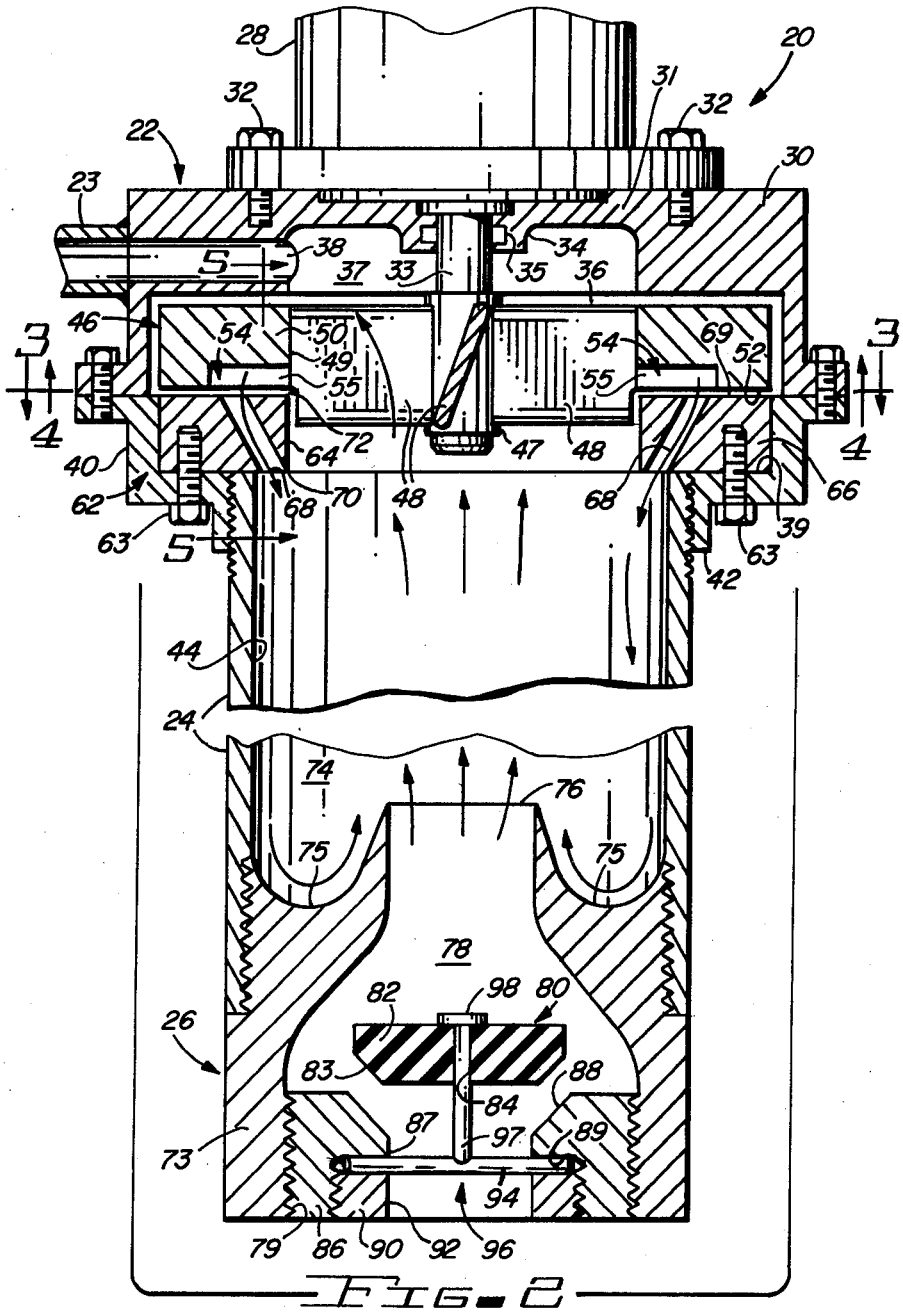
FIG. 2 is an enlarged fragmentary sectional view of the pump of the present invention taken along the line 2—2 of FIG. 1.

The rotary sonic pressure wave generator 22, as seen best in FIG. 2, includes a water base housing 30 having a substantially planar upper wall 31 upon which the drive means 28 is suitably mounted, such as with bolts 32, so that the output shaft 33 of the drive means 28 depends through a boss 34 formed in the upper wall 31 and which is provided with a suitable seal 35 in its bore with the shaft extending axially into a rotor chamber 36 defined by the water base housing 30. The rotor chamber 36 is of generally cylindrical configuration and is in open communication with a coaxial reduced diameter liquid discharge chamber 37 which has a liquid discharge port 38 extending radially therefrom into communication with the liquid discharge pipe 23. The rotor chamber 36 opens downwardly into an upwardly opening coaxial stator chamber 39 which is of generally cylindrical configuration and is formed in an adapter housing 40. The adapter housing 40, which is suitably assembled to the water base housing 30, is provided with an internally threaded boss 42 which extends axially therefrom with the metallic production tube 24 being threadingly carried therein. In this manner, the bore 44 of the production tube 24 is in open axial communication with the stator chamber 39, the rotor chamber 36, and the liquid discharge chamber 37. The water base housing 30, and the adapter housing 40 provide a housing means of the sonic pressure wave generator with the housing means defining an internal chamber cooperatively formed by the stator chamber 39, rotor chamber 36 and the liquid discharge chamber 37.

A rotor 46 is fixedly attached in a suitable manner on the depending end of the shaft 33 of the drive means 28 so as to be rotatably disposed within the rotor chamber 36 of the water base housing 30. As seen in FIGS. 2 and 4, the rotor 46 is a disc-shaped structure having a central hub 47 with a plurality of impeller blades 48 extending radially therefrom to span a central opening 49 formed axially through the rotor. A ring-shaped rotor body 50 is carried on the extending ends of the impeller blades 48 so as to circumscribe the axial opening 49 of the rotor. The rotor body is provided with an endless planar working surface 52 in which a plurality of especially configured liquid impacting cavities, or notches, 54 are formed in a circular array.

As seen best in FIG. 4, each of the cavities 54 extend radially into the ring-shaped rotor body 50 and open radially into the axial opening 49 as at 55, with the opposite end being closed by an end wall 56. The cavities open onto the planar working surface 52 of the rotor body 50, with the openings being defined by the hereinbefore described radially open ends 55 and the walls 56, and by leading edges 57 and trailing edges 58. The leading and trailing edges 57 and 58, respectively, are spaced apart and extend between the open ends 55 and the walls 56, and are referred to as being leading and trailing due to their relationship with respect to the rotational direction of the rotor body 50 as shown by the arrow in FIG. 4.

Each of the liquid impacting cavities 54 is provided with a recessed liquid impacting surface 60 with those surfaces extending angularly from the trailing edges 58 of the cavities into the rotor body 52. This angular attitude of the liquid impacting surface 60 is seen best in FIG. 5, wherein a typical one of the cavities 54 is shown. Although the angle of the liquid impacting surface 60 is not particularly critical, it has been found that an included angle of about 30° between the liquid impacting surface 60 and the working surface 52 works quite satisfactorily. The remaining recessed wall 61 in each of the cavities 54 is not critical with regard to its angular orientation.

The impeller blades 48 of the rotor 46 are angularly disposed, as seen in FIG. 2, so as to augment the liquid flow from the production tube 24 through the stator chamber 39, the rotor chamber 36, the discharge chamber 37, and through the discharge port 38 as will hereinafter be described in detail. As seen in FIG. 2, the impeller blades 48 may be formed so that they extend below the plane of the working surface 52 of the rotor 46. Although this is not necessary, it has been found that such an impeller blade configuration enhances the flow inducing characteristics of the rotor 46.

A stator 62 is fixedly attached, such as by suitable bolts 63, in the stator chamber 39 of the adapter housing 40. The stator 62 is a disc-shaped structure with an axial opening 64 formed therethrough which is circumscribed by a ring-shaped stator body 66. As seen best in FIGS. 2 and 3, the ring-shaped stator body 66 is provided with a plurality of passages 68 extending between its opposite planar surfaces 69 and 70. The number of passages 68 is equal to the number of the above described liquid impacting cavities 54 formed in the rotor 46, and are disposed in the same circular array and equally spaced radial increments, as are the cavities.

The rotor 46 and the stator 62 are mounted in their respective chambers 36 and 39, so that the working surface 52 of the rotor body 50 and the upper surface 69 of the stator body 66 are parallel and are spaced from each other to form a small gap 72 therebetween.

As will hereinafter be described, the rotor 46 and stator 62 interact during operation of the pump 20 to generate sonic pressure waves in the column of liquid (not shown) contained within the pump when it is operating. These generated sonic pressure waves move through the production tube 24 adjacent the inner walls thereof which defines the bore 44 of the production tube and enter into the pumping unit 26 carried on the extending end thereof.

The pumping unit 26 includes a pump housing 73 which is of substantially cylindrical configuration and is threadingly carried on the depending end of the production tube. The upper end of the pump housing 73 cooperates with the bore 44 of the lower end of the production tube 24 to form a reflector/aspiration chamber 74. The upwardly facing end of the pump housing 73 is formed with an upwardly opening, or semi-toroidal surface 75, which circumscribes an axial orifice 76. The cross sectional curve of the semi-toroidal surface 75 may be semi-circular, parabolic, or other suitable curve which receives the generated sonic pressure waves from the production tube 24 and reflects them so that the reflected sonic pressure waves are returned centrally into the bore 44 of the production tube and move axially therethrough countercurrent to the movement of the generated sonic pressure waves. Such reflection of the sonic pressure waves causes them to circumferentially move past the axial orifice 76 and this results in an aspiration effect which produces a partial vacuum in a liquid admitting chamber 78 formed in the pump housing 73 of the pumping unit 26 below the axial orifice. The liquid admitting chamber 78 is of generally bell-shaped configuration, with its downwardly opening end being provided with internal threads 79 by which a one-way check valve means 80 is mounted therein.

The check valve means 80 includes a circular disc-shaped valve body 82, formed such as of rubber, and having an endless beveled surface 83 formed thereon with an axial aperture 84 formed therethrough. An externally threaded valve seat body 86 is mounted in the downwardly opening portion of the liquid admitting chamber 78 and has an axial bore 87 formed therethrough. The inwardly facing end of the axial bore 87 of the valve seat body 86 is provided with an endless beveled valve seat surface 88 upon which the valve body 82 is sealingly seatable and the opposite end of the axial bore 87 is of enlarged diameter to form an annular shoulder 87 therein and having internal threads in the enlarged diameter portion of the bore for mounting of a retainer plug 90 therein. The retainer plug 90 is formed with an axial bore 92 and is employed to retain the cross bar 94 of a T-shaped guide 96 by captively holding the cross bar 94 in engagement with the shoulder 89 provided in the bore 87 of the valve seat body 86. The cross bar 94 of the T-shaped guide transversely spans the bore 87 of the valve seat body 86 and is provided with a rod 97 extending normally from intermediate its opposite ends so as to extend axially into the liquid admitting chamber 78 of the pumping unit 26. The rod 97 passes loosely through the axial aperture 84 of the valve body 82 and is provided with an enlarged head, or stop 98, on its extending end. The valve body 82 is slidably movable on the rod 97 of the guide 96 between an open position shown in FIG. 2 and a closed position wherein the valve body 82 is in seated engagement with the valve seat 88 of the valve body 86.

OPERATION

As mentioned above, with the pump 20 primed, i.e., containing a column of liquid (not shown), rotational driving of the rotor 46 will interact with the stator 62 to generate the sonic pressure waves, as will hereinafter be described, which move through the production tube 24 about the inner wall which defines the bore 44 thereof, to the pumping unit 26. The generated sonic pressure waves are reflected centrally back into the production tube and produce a partial vacuum in the liquid admitting chamber 78. The partial vacuum will lift the valve body 82 off of the seat 88, thus placing the bore 44 of the production tube 24 in communication with the liquid to be pumped 14 (FIG. 1) via the pumping unit 26. It will be seen that the valve body 82 is normally closed due to the gravitational and head pressure forces exerted thereon.

When the one-way check valve 80 is opened as a result of the aspiration induced partial vacuum in the liquid admitting chamber 78, the liquid to be pumped will be sucked into the pumping unit 26 and will be carried by the reflected sonic pressure waves axially through the bore 44 to the sonic pressure wave generator 22. The flow inducing action of the impeller blade 48 of the rotor 46 will augment the flow of the liquid being pumped and the largest portion of the pumped liquid, approximately 90%, will pass through the sonic pressure wave generator and exit through the port 38 and liquid discharge pipe 23. The balance, approximately 10% of the liquid so pumped, will flow into the liquid impacting cavities 54 of the rotor and will exit those cavities through the apertures 68 of the stator 62 when the cavities 54 rotatably move into overlaying alignment with the apertures 68 of the stator 62.

The relatively small amount of pumped liquid passing through the apertures 68 of the stator 62 will move through the bore 44 of the production tube 24 adjacent the inner walls thereof and thus will produce hydraulic pressure waves which move toward the pumping unit 26. The operating efficiency of the pump 20 far exceeds that which could reasonably be expected if the pump's operation were solely dependent on those hydraulic forces.

As hereinbefore mentioned, exactly what occurs in the sonic pressure wave pump of the present invention is not clearly understood. However, extensive testing, experimentation and observations lead me to believe that the sonic pressure waves are responsible for the unexpected pump efficiency with the hydraulic forces augmenting the effect of the sonic pressure waves.

The pumped liquid will continuously flow into the liquid impacting cavities 54 as hereinbefore mentioned, so that they contain liquid under pressure. The pressurized state of the liquid in the cavities 54 results from the force of the pumped liquid being supplied thereto and further due to centrifugal forces. This pressurized state of the cavities will exist until they pass over the apertures 68 of the rotor 62 which will suddenly release the pressurized liquid into the apertures 68 with the liquid impacting surfaces 60 of the cavities 54 exerting an impacting force on the exiting liquid. The exiting liquid produces the above described hydraulic force and the impacting thereof generates the sonic pressure waves.

In the illustrated example, the liquid impacting cavities 54 and the passages 68 are seen to be eight in number. Thus, eight separate sonic pressure waves and hydraulic pressure waves will be simultaneously generated for each one-eighth of a revolution of the rotor with those eight simultaneously generated sonic pressure waves, as well as the hydraulic pressure waves, being generated at eight equally spaced radial increments. The number of the cavities 54 and passages 68 can be varied within reason, without significantly effecting the operation of the pump 20.

The reason for the apparent ease which the reflected sonic pressure waves carry the liquid from the pumping unit 26 to the generator 22 is the main thing which is not clearly understood in the operation of the pump of the present invention. It is believed that the generated sonic pressure waves moving adjacent the wall of the bore 44 of the production tube 24 forms some sort of a membrane which reduces the friction which would normally exist, and this allows the reflected sonic pressure waves and the pumped liquid carried thereby to move axially and in a countercurrent flow path through the production tube 24 in a frictionless, or at least a reduced friction manner.

The exact nature of the sonic pressure waves is unknown as hereinbefore mentioned, however, it is believed that they are basically sonic in nature due to a throbbing, or pulsing, noise which radiates from all points along the production tube and the pumping unit 26. In the absence of this noise, the pump simply won't work. It is also believed that some sort of an electrical characteristic is present in the sonic pressure waves. This belief is predicated on a discovery made during a test when a length, or segment, of the metallic production tube 24 was replaced with a non-metallic, and thus electrically insulative, segment. When the production tube 24 included the non-metallic segment, all attempts to make the pump work failed. Normal pump operation commenced as soon as the non-metallic segment was replaced with a metallic segment.

Referring once again to FIGS. 3 and 5, wherein it will be seen that a plurality of special radial grooves 100 are machined, or otherwise formed, in the upwardly facing surface 69 of the ring-shaped rotor body 66. These grooves 100 are seen to open onto the surface 69 and are closed at their opposite ends, with there being, in the preferred embodiment, two radially spaced grooves 100 between each of the apertures 68 of the stator 62. As seen in FIG. 5, the grooves 100 are angularly formed in the surface 69 of the stator so as to angularly open onto that surface in a direction opposite to the rotational direction of the rotor 46. The purpose for these grooves 100 is to inhibit rotational induced movement of the liquid in the space, or gap 72, between the rotor and the stator. In the absence of such grooves, rotation of the rotor would inherently carry some of the liquid in the gap 72 with the rotating rotor, and this would reduce the pressure of the liquid in the liquid impacting cavities 54 of the rotor. With the grooves 100 provided as described above, rotationally moved liquid will move into the angularly recessed grooves 100 and will flow out of those grooves in a direction which is substantially countercurrent to the rotationally moved liquid, and will thus hamper the rotationally induced liquid flow.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A sonic pressure wave operated pump for pumping liquids and having a column of liquid therein, said pump comprising:

(a) a sonic pressure wave generator having a liquid discharge port and having a rotor and a stator therein;

(b) a metallic production tube coupled to said sonic pressure wave generator and extending therefrom toward the liquid to be pumped;

(c) said rotor and said stator having complimentary elements of a liquid impacting means formed therein for generating sonic pressure waves which move through said production tube along the inner walls thereof toward the liquid to be pumped; and (d) a pumping unit on the extending end of said production tube and in communication with the liquid to be pumped, said pumping unit having means for receiving the generated sonic pressure waves from said production tube and reflecting them back through the center of said production tube and reacting to the reflection by intaking the liquid to be pumped to allow the reflected sonic pressure waves to carry the intaken liquid through said production tube and said sonic pressure wave generator to the liquid discharge port thereof.

2. A sonic pressure wave operated pump as claimed in claim 1 wherein said rotor and said stator of said sonic pressure wave generator are coaxially disposed transverse to the column of liquid contained in said sonic pressure wave operated pump and impactingly generate a plurality of sonic pressure waves for each revolution of said rotor.

3. A sonic pressure wave operated pump as claimed in claim 2 wherein said complimentary elements of a liquid impacting means formed in said rotor and in said stator of said sonic pressure wave generator are disposed to impactingly generate the sonic pressure waves at plural points lying on a circle in the transverse plane of said rotor and said stator with the circle being concentric with the column of liquid contained in said sonic pressure wave operated pump.

4. A sonic pressure wave operated pump as claimed in claim 1 wherein said sonic pressure wave generator further comprises:

(a) housing means defining an internal chamber which is open to the bore of said production tube and has said liquid discharge port formed therein;

(b) said stator fixedly mounted in the chamber of said housing means in coaxial transverse relationship with the longitudinal axis of said production tube, said stator being of disc-shaped configuration with a central opening circumscribed by a ring-shaped stator body, the stator portion of said complimentary elements of a liquid impacting means including at least a pair of passages arranged in diametrically opposed sides of said stator body and extending between the opposite planar surfaces thereof; and (c) said rotor rotatably disposed in the chamber of said housing means in coaxial overlaying relationship with said stator, said rotor being of disc-shaped configuration with a central opening circumscribed by a ring-shaped rotor body having one planar surface in closely spaced coextending relationship with one of the planar surfaces of said stator body, the rotor portion of said complimentary elements of a liquid impacting means being at least a pair of cavity means arranged in diametrically opposed sides of said rotor body in the one of the planar surfaces thereof so as to rotatingly move into and out of alignment with the passages of said stator when said rotor is rotatably moved for impactingly generating the sonic pressure waves when said cavities of said rotor move into alignment with said passages of said stator.

5. A sonic pressure wave operated pump as claimed in claim 4 wherein each of said pair of cavities of said rotor opens radially into the central opening of said rotor and has an angularly inwardly extending recessed liquid impacting surface.

6. A sonic pressure wave operated pump as claimed in claim 4 and further comprising impeller means in the central opening of said rotor for augmenting the flow of the intaken liquid.

7. A sonic pressure wave operated pump as claimed in claim 1 wherein said sonic pressure wave generator further comprises:

(a) housing means defining an internal chamber which is open to the bore of said production tube and has said liquid discharge port formed therein;

(b) said stator fixedly mounted in the chamber of said housing means in coaxial transverse relationship with the longitudinal axis of said production tube, said stator being of disc-shaped configuration with a central opening circumscribed by a ring-shaped stator body, the stator portion of said complimentary elements of a liquid impacting means being a plurality of passages arranged in a circular array in said stator body and extending between the opposite planar faces thereof; and (c) said rotor rotatably disposed in the chamber of said housing means in coaxial overlaying relationship with said stator, said rotor being of disc-shaped configuration with a central opening circumscribed by a ring-shaped rotor body having one planar surface in closely spaced coextending relationship with one of the planar surfaces of said stator body, the rotor portion of said complimentary elements of a liquid impacting means being a plurality of cavity means arranged in a circular array in the one planar surface of said rotor body so as to rotatingly move into and out of alignment with the passages of said stator when said rotor is rotatingly moved for impactingly generating the sonic pressure waves when said cavities of said rotor move into alignment with said passages of said stator.

8. A sonic pressure wave operated pump as claimed in claim 7 wherein each of said plurality of cavity means of said rotor body has one end opening radially into the central opening of said rotor with the other end being closed, said cavity opening onto the one planar surface of said rotor body and having a spaced pair of edges extending between its open and closed ends with one of those edges being a trailing edge with relation to the rotational direction of said rotor, said cavity having a recessed impacting surface which extends angularly into said rotor body from the trailing edge of said cavity.

9. A sonic pressure wave operated pump as claimed in claim 8 wherein said recessed impacting surface extends into said rotor body at an acute angle relative to the one planar surface of said rotor body.

10. A sonic pressure wave operated pump as claimed in claim 8 wherein said recessed impacting surface extends into said rotor body at an angle of about 30° with respect to the one planar surface of said rotor body.

11. A sonic pressure wave operated pump as claimed in claim 7 and further comprising impeller means in the central opening of said rotor for augmenting the movement of the intaken liquid.

12. A sonic pressure wave operated pump as claimed in claim 7 wherein said sonic pressure wave generator further comprises:

(a) drive means mounted on said housing means with an output shaft extending into the internal chamber thereof;

(b) said rotor having a central hub fixedly attached to the output shaft of said drive means; and (c) a plurality of impeller blades extending radially and integrally between the central hub of said rotor and said rotor body.

13. A sonic pressure wave operated pump as claimed in claim 1 wherein said means of said pumping unit for receiving the generated sonic pressure waves from said production tube and reflecting them back through the center of said production tube and reacting to the reflection by intaking the liquid to be pumped includes a reflector/aspirator chamber formed in said pumping unit which reflects the generated sonic pressure waves and reacts by producing a partial vacuum in said pumping unit for intaking the liquid to be pumped.

14. A sonic pressure wave operated pump as claimed in claim 1 wherein said pumping unit comprises:

(a) a housing coupled to the extending end of said production tube so as to extend axially therefrom;

(b) a liquid admitting chamber formed in the axially extending end of said housing and opening into communication with the liquid to be pumped;

(c) check valve means in said housing at the open end of said liquid admitting chamber to allow the flow of the liquid to be pumped into said liquid admitting chamber and to prevent reverse flow; and (d) a reflector/aspirator chamber means formed in the opposite end of said housing with said housing having an axial orifice disposed between said reflector/aspirator chamber and said liquid admitting chamber, said reflector/aspirator chamber for receiving the generated sonic pressure waves from said production tube and reflecting them back into the center of said production tube in a path which moves circumferentially past said axial orifice to produce a partial vacuum in said liquid admitting chamber for opening of said check valve means and intaking of the liquid to be pumped.

15. A sonic pressure wave operated pump as claimed in claim 14 wherein said reflector/aspirator chamber means includes a semitoroidal surface which circumscribes the axial orifice of said housing and is in open communication with the bore of said production tube.

16. A sonic pressure wave operated pump as claimed in claim 14 wherein said check valve means comprises:

(a) a valve seat body mounted in said housing at the open end of said liquid admitting chamber, said valve seat body having a bore which extends between said liquid admitting chamber of said housing and the liquid to be pumped and is configured to provide a valve seat which circumscribes the bore of said valve body at the end thereof which opens into said liquid admitting chamber;

(b) a valve body for movement onto and off of the valve seat of said valve seat body; and (c) guide means connected to said valve seat body and to said valve body for guiding and limiting the movement of said valve body.

* * * * *